US011725903B2

(12) United States Patent
Law

(10) Patent No.: US 11,725,903 B2
(45) **Date of Patent: *Aug. 15, 2023**

(54) FOLDING STOCK ADAPTER FOR MILITARY-STYLE ASSAULT RIFLES AND A METHOD FOR ITS USE

(71) Applicant: Zachary Law, Perkasie, PA (US)

(72) Inventor: Zachary Law, Perkasie, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/986,878

(22) Filed: Nov. 14, 2022

(65) Prior Publication Data

US 2023/0081700 A1 Mar. 16, 2023

Related U.S. Application Data

(63) Continuation of application No. 16/175,704, filed on Oct. 30, 2018, now Pat. No. 11,499,795, which is a continuation of application No. 15/665,045, filed on Jul. 31, 2017, now Pat. No. 10,113,832, which is a continuation of application No. 14/308,701, filed on Jun. 18, 2014, now Pat. No. 9,719,754, which is a continuation of application No. 13/453,775, filed on Apr. 23, 2012, now Pat. No. 8,769,855.

(60) Provisional application No. 61/600,686, filed on Feb. 19, 2012.

(51) Int. Cl.

| | |
|---|---|
| ***F41A 11/04*** | (2006.01) |
| ***F41C 23/14*** | (2006.01) |
| ***F41C 23/04*** | (2006.01) |

(52) U.S. Cl.

CPC ..... *F41C 23/14* (2013.01); *F41A 11/04* (2013.01); *F41C 23/04* (2013.01)

(58) Field of Classification Search

CPC ..... F41C 23/04; F41C 23/14; F41A 11/04
USPC ..... 42/75.03, 73, 71.01
See application file for complete search history.

(56) References Cited

U.S. PATENT DOCUMENTS

| | | | | | |
|---|---|---|---|---|---|
| 2,361,180 | A | * | 10/1944 | Dobremysl | F41A 11/00 42/106 |
| 2,424,944 | A | * | 7/1947 | William | F41C 23/04 42/72 |
| 2,447,091 | A | * | 8/1948 | Pope | F41A 11/00 42/76.01 |
| 3,369,316 | A | * | 2/1968 | Miller | F41C 23/04 42/72 |
| 3,380,183 | A | * | 4/1968 | Sullivan | F41A 19/46 42/75.02 |
| 4,028,993 | A | * | 6/1977 | Reynolds | F41A 3/78 89/130 |
| 4,383,384 | A | * | 5/1983 | Fox | F41C 23/04 42/72 |
| 4,735,007 | A | * | 4/1988 | Gal | F41C 23/00 D22/104 |

(Continued)

*Primary Examiner* — Michael D David
(74) *Attorney, Agent, or Firm* — Muskin & Farmer, LLC

(57) ABSTRACT

The present folding stock adapter can be used with many types of military-type assault rifles that typically comprise a receiver extension, buffer and action spring. The present folding stock adapter can be used to add a folding capability to a standard stock allowing it to fold against a rifle's receiver when the weapon is not in use, thus reducing the overall length of the weapon. This reduction in length can facilitate its maneuverability, storage and transport in cramped quarters. The present device can also allow for the quick unfolding of the stock in order to allow the weapon to function and be fire normally.

17 Claims, 8 Drawing Sheets

(56) References Cited

U.S. PATENT DOCUMENTS 5,173,564 A * 12/1992 Hammond, Jr. ..... F41C 23/00 42/75.03
5,272,956 A * 12/1993 Hudson ..... F41A 5/28 89/193
6,591,533 B2 * 7/2003 Wygant ..... F41C 23/04 42/75.01
6,901,691 B1 * 6/2005 Little ..... F41G 1/41 42/118
7,162,822 B1 * 1/2007 Heayn ..... F41C 23/06 42/71.01
7,673,412 B2 * 3/2010 Griffin ..... F41C 23/04 42/71.01
7,802,392 B2 * 9/2010 Peterson ..... F41C 23/14 42/75.03
7,934,447 B2 * 5/2011 Kuczynko ..... F41A 5/28 89/193
7,966,761 B1 * 6/2011 Kuczynko ..... F41C 23/04 42/73
8,186,090 B1 * 5/2012 Chiarolanza ..... F41C 23/04 42/73
8,245,429 B2 * 8/2012 Kuczynko ..... F41C 23/04 42/73
D674,859 S * 1/2013 Robbins ..... D22/108
D682,383 S * 5/2013 Underwood ..... D22/108
8,631,601 B2 * 1/2014 Langevin ..... F41C 23/04 42/73
8,769,855 B2 * 7/2014 Law ..... F41C 23/14 42/73
8,991,088 B1 * 3/2015 Young ..... F41C 23/04 42/75.03
9,719,754 B2 * 8/2017 Law ..... F41C 23/04
10,113,832 B2 * 10/2018 Law ..... F41C 23/04
2005/0215092 A1 * 9/2005 Schoppman ..... F41A 11/04 439/101
2005/0262752 A1 * 12/2005 Robinson ..... F41A 5/18 42/75.01
2006/0242880 A1 * 11/2006 Griffin ..... F41C 23/04 42/73
2008/0028662 A1 * 2/2008 Abraham ..... F41C 23/14 42/74
2009/0277066 A1 * 11/2009 Burt ..... F41A 3/66 89/1.4
2010/0030704 A1 * 2/2010 Griffin ..... G06Q 40/00 705/37
2010/0212206 A1 * 8/2010 Griffin ..... F41C 23/04 42/73
2013/0212920 A1 * 8/2013 Law ..... F41C 23/14 42/75.03
2015/0075051 A1 * 3/2015 Law ..... F41A 11/04 42/75.03
2015/0345895 A1 * 12/2015 Young ..... F41A 3/84 42/71.01

* cited by examiner

FOLDING STOCK ADAPTER FOR MILITARY-STYLE ASSAULT RIFLES AND A METHOD FOR ITS USE

CROSS REFERENCE TO RELATED APPLICATIONS

This is a continuation of application Ser. No. 16/175,704 filed Oct. 30, 2018, which is a continuation of application Ser. No. 15/665,045 filed Jul. 31, 2017, which is a continuation of application Ser. No. 14/308,701, filed on Jun. 18, 2014, which is a continuation of application Ser. No. 13/453,775, filed Apr. 23, 2012, which claims benefit to provisional application 61/600,686, filed Feb. 19, 2012, all of which are incorporated by reference herein in their entirety.

FIELD OF THE INVENTION

The present device is an adapter comprising a hinge mechanism that can be used to add a folding capability to the stocks of many types of military-style assault rifles, including the well-known M-16 and AR-15.

BACKGROUND

The utility of semi-automatic or automatic rifles can depend upon the physical size of the rifle, especially in military or law enforcement situations where space can be limited. For example, a longer rifle can be more unwieldy than a compact rifle within the cramped quarters of an armored vehicle, aircraft, or patrol car, making the transport, storage and maneuverability of the rifle cumbersome. Gunstocks often represent over one-third of the total length of any particular rifle, so the ability to fold the stock of a rifle against its remaining sections can significantly reduce the space required to store and maneuver the rifle.

Many types of folding stocks currently exist for most military-style assault rifles. See U.S. Pat. No. 7,162,822 by Heayn et al. among many others. Additionally, various types of collapsible or telescoping stocks are also currently available. However, a collapsible stock apparatus does not fully solve the size problem because that type of stock slides along a rifle's receiver extension, which typically contains the buffer and action spring used to actuate such rifles. Therefore, these devices can only shorten the stock, by a length that does not include the receiver extension, which can often account for one-third or more of the total length of the stock.

Alternatively, some folding stock adapters have been designed to allow fixed stocks the ability to fold. See U.S. Pat. No. 7,966,761 by Kuczynko et al. among many others. However, these existing folding stock adapters have been less than ideal; because certain parts of some military-style assault rifles, such as the action spring and bolt carrier, travel from the receiver of the firearm into the receiver extension, which is located within the stock of the rifle. Therefore, a folding stock adapter for such guns must be able to account for the weapon's bolt carrier, buffer and action spring when the weapon is either in a folded position or an unfolded position. The present workarounds for folding stock adapter have required reduced functionality in order to address this issue.

What is needed is a folding stock adapter for use with military-style assault rifles which can accommodate the standard bolt carriers, buffers, receiver extensions and action springs comprising such weapons, which can also allow the stocks of such weapons to be folded over against the remaining parts of the rifle to substantially reduce its overall physical size, allowing easier transport, storage and maneuverability in space restrictive conditions, while allowing the rifle to be quickly unfolded to function and fire normally.

SUMMARY OF THE INVENTION

It is an aspect of the present device to provide a folding stock adapter, which can accommodate standard receiver extension, buffer, bolt carrier and action spring comprising many military-style assault rifles, that is capable of allowing a rifle's stock to fold securely against its receiver, thus reducing the length of the rifle by nearly the full length of the stock, but can also be quickly unfolded into a functional position and fired normally. The present folding stock adapter can be designed for use with any weapon that comprises a standard commercial or military-style receiver extension, buffer, bolt carrier and action spring.

The above aspect can be obtained by a folding stock adapter comprising: a dead hinge section, configured to connect to a receiver; a live hinge section configured to connect to a stock; a hinged joint configured to connect the live hinge section to the dead hinge section allowing the live hinge section and dead hinge section to move between an open position and a closed position; a threaded flange configured to connect the dead hinge section to the receiver; and a bolt carrier extension.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1A:
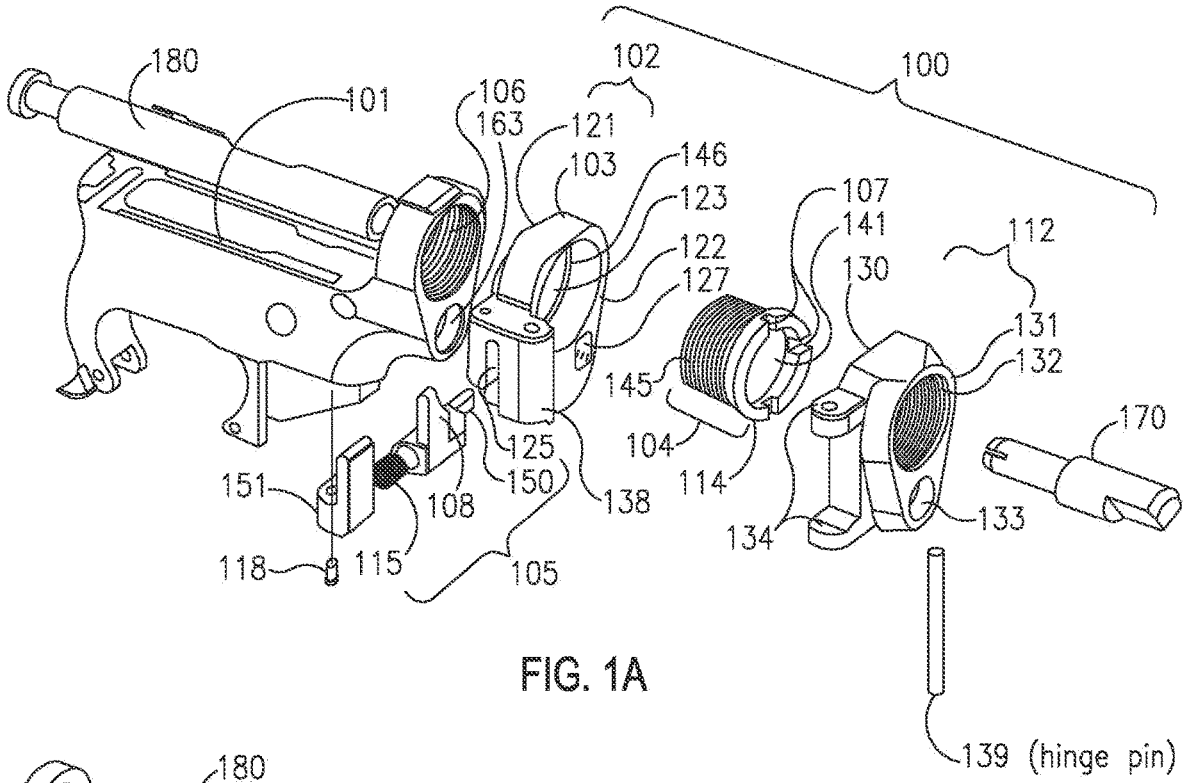
FIG. 1A is an exploded rear, top and side perspective view drawing of a folding stock adapter and a receiver (prior art), such as those commonly comprising military-style assault rifles, according to an embodiment.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

The present folding stock adapter can be used to modify a military-style assault rifle using only the folding stock adapter, along with the rifle's standard stock, receiver, buffer, bolt carrier and action spring so that its stock can be configured to fold against the rifle's receiver, reducing the length of the weapon by nearly the full length of the stock. In an embodiment, the folding stock adapter can comprise a non-moving (in relation to the receiver) section, (referred to hereinafter as the "dead hinge section") connected by a hinged joint to a moving section (in relation to the receiver), (referred to hereinafter as the "live hinge section"). The dead hinge section can be connected to the receiver of a typical military-style assault rifle by placing a threaded flange through the dead hinge section and screwing the threaded flange into a rear threaded section comprising many receivers. Similarly, the live hinge section can be connected to the stock of the assault rifle by screwing a receiver extension, such as those that typically comprise the stocks of most military-style assault weapons, into a threaded opening comprising the live hinge section. When the dead hinge section comprising the present folding stock adapter is connected to the receiver and the live hinge section is connected to the rifle's stock, the stock can be folded flat against the receiver when the folding stock adapter is in an open position. In an embodiment, the folding stock adapter can comprise a button or latch, which can be pressed in order to release the dead hinge section from the live hinge section, allowing the folding stock adapter to be moved from a closed position to an open position in order to fold the stock.

Additionally, the present folding stock adapter also comprises a bolt carrier extension, which can compensate for the additional length added by the live hinge section and the dead hinge section buffer and bolt carrier can maintain proper contact and communication between them.

The present folding stock adapter can be configured for use with multiple types of military-style assault rifles, including, but not limited to the M-16, M-4, AR-15, SR-25, M-110, AR-10 and HK-416, among others. The present folding stock adapter can be composed in full or in part of various metals, including, but not limited to, aluminum, steel, or any other alloys, plastics, carbon fiber, composites, or any other suitable materials known to those of ordinary skill in the art of firearm manufacturing.

FIG. 1A is an exploded rear, top and side perspective view drawing of a folding stock adapter 100 and a receiver 101, such as those commonly comprising many military-style assault rifles, according to an embodiment. (The receiver 101 shown in FIGS. 1A, 2, 3, 4, and 5 represents prior art, which is not part of the present folding stock adapter, but is shown only to provide a familiar point of reference.)

In an embodiment, the folding stock adapter 100, as depicted in FIG. 1A, can be comprised of a dead hinge section 102 and a live hinge section 112, wherein the dead hinge section 102 can be connected to the receiver 101 and the live hinge section 112 can be connected to a receiver extension (not shown in FIG. 1A) comprising the stock of the rifle. (Neither the receiver extension nor the stock comprise any part of the present folding stock adapter, but are standard parts comprising many military-style assault rifles.)

In an embodiment, the dead hinge section tube 103 can comprise a first dead hinge section side 121, a second dead hinge section side 122, and a circular dead hinge section opening 123 within a dead hinge section tube 103. The first dead hinge section side 121 can be configured to be secured to the rear threaded section 106 of the receiver 101. The second dead hinge section side 122 can be configured to be connected to the live hinge section 112 and abut against the live hinge section 112 when the folding stock adapter 100 is in a closed configuration. In an embodiment, the second dead hinge section side 122 can comprise an indentation 127 configured to accept a connecting tab (not visible in FIG. 1) comprising the live hinge section 112, which can be used to secure the present folding stock adapter 100 in a closed position.

In an embodiment, the dead hinge section 102 can comprise a circular dead hinge section opening 123 configured to allow a threaded flange 104 to pass mostly through the circular dead hinge section opening 123. The threaded flange 104 can comprise a threaded body 145 which can be configured to be screwed into the rear threaded section 106 of the receiver 101, where a receiver extension (not shown in FIG. 1A) would typically connect to the receiver 101. The threaded flange 104 can also comprise a head 114, which can be configured to abut up against a raised lip 146 located within the dead hinge section opening 123. When the threaded flange 104 is screwed into the rear threaded section 106 of the receiver 101, the dead hinge section 102 can be placed against, and connected to the receiver 101. The threaded flange 104 can also comprise slots 107, which can be used to facilitate turning the threaded flange 104, in order to screw it into the rear threaded section of the receiver 101. The force of the head 114 against the raised lip 146 can securely connect the dead hinge side 102 to the receiver 101, according to an embodiment.

In an embodiment, the dead hinge section 102 can also comprise a slot 125 configured to receive a locking button assembly 105 that can extend through the dead hinge section 102. A button 150, comprising the locking button assembly 105 can extend through the slot 125 comprising the dead hinge section 102 and pass out of the opposite side (not shown in FIG. 1A) of the dead hinge section 102 so that it can be pushed by a user's thumb or finger. Pressing the button 150 into the slot 125, can thus actuate the locking button assembly 105. In an embodiment, the locking button assembly 105 can be spring-loaded through use of a locking button spring 115 in order to hold the button 150 in a locked position until the button 150 is pressed into the slot 125 and into an unlocked position. In an embodiment, the button 150 can be pressed in order to allow the live hinge section 112 to pivot about the dead hinge section 102 between an open position and a closed position using a hinged joint comprised of a hinge pivot 138 and two hinge tabs 134 joined by a hinge pin 139. In an embodiment, the hinged joint can comprise one or more stays configure to hold the stock in either an open position or a closed position until a force sufficient to overcome the stay is applied to the hinged joint.

In an embodiment, the locking button assembly 105 can further comprise a button cover 151, which can be used to retain the remaining parts of the locking button assembly 105 through the use of a setscrew 118, which can connect the locking button assembly 105 to the dead hinge section 102. In an embodiment, the locking button assembly 105 can comprise a tab 108, which can extend through the slot 125 and into the dead hinge section opening 123 comprising the dead hinge section 102. This tab 108 can act as a stay, which can be configured to prevent the bolt carrier assembly 180 from falling out of the receiver 101 when the folding stock adapter 100 is in an open (folded) position. This tab 108 can be configured to move into the slot when the folding stock adapter 100 is in a closed position thus allowing the action spring and buffer unobstructed access to the bolt carrier extension 170 and bolt carrier assembly 180.

In an embodiment, the live hinge section 112 can comprise a first live hinge side 130 and a second live hinge side 131. When the folding stock adapter 100 is in a closed position, the first live hinge side 130 of the live hinge section 112 can be placed against the second dead hinge side 122 of the dead hinge section 102. The live hinge section 112 can further comprise two hinge tabs 134, which can be connected to the hinge pivot 138 comprising the dead hinge section 102.

In an embodiment, the live hinge section 112 can also comprise an aligning indentation 133 which can match the aligning indentation 163 located on the rear section of the receiver 101. This aligning indentation 133 can be used to align the stock (not shown in FIG. 1A) against the second live hinge side 131 by using an aligning tab on the stock (not shown in FIG. 1A), which can be configured to fit within the aligning indentation 133. A rifle can be connected to the live hinge section 112 by screwing a standard receiver extension comprising the rifle stock into a threaded circular receiver hole 132, which can be configured to allow an action spring and buffer (not pictured) to contact the bolt carrier extension 170. (Note that although threaded connections are used to connect the dead hinge 102 to the receiver 101 and the stock of the weapon to the live hinge section 112, various alternative types of connectors could be used to facilitate these connections.) The folding stock adapter can be configured so that when the dead hinge side 102 is connected to rear threaded section 106 of the receiver 101 by the threaded flange 104, and the live hinge section 112 is abutted against the dead hinge section 102, thus forming a continuous opening from the receiver 101 to the receiver extension, which can allow the action spring and buffer (not shown in FIG. 1A) to contact the bolt carrier extension 170 in order to actuate the bolt carrier assembly 180. The bolt carrier assembly 180, comprising typical military-style assault rifles is actuated by the action spring and buffer, which are pushed backward by gas pressure produced by a cartridge when it is fired then moves forward when the gas pressure subsides. This back and forth, reciprocating motion allows the weapon to eject spent cartridges and chamber new ones thus preparing the weapon to re-fire with each cycle.

Figure 1B:
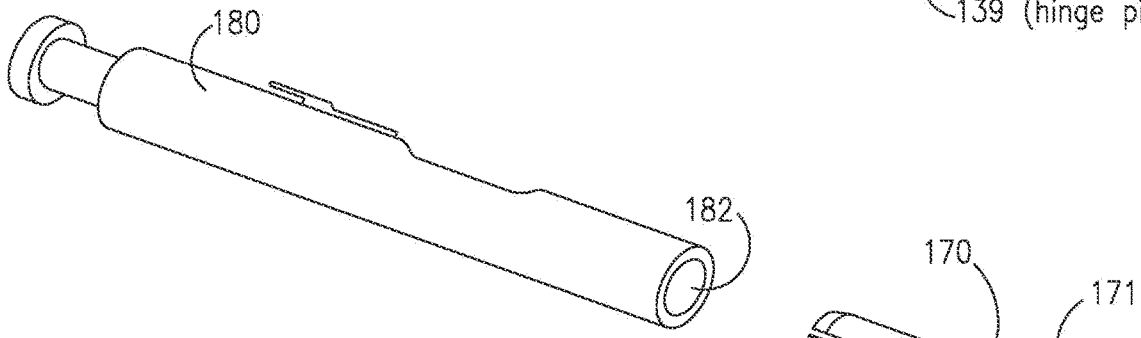
FIG. 1B is an exploded rear, top and side perspective view drawing of a bolt carrier assembly, including a bolt carrier extension, according to an embodiment.
Figure 1B:
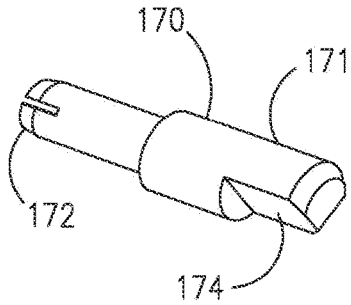

FIG. 1B is an exploded rear, top and side perspective view drawing of a bolt carrier assembly 180, including a bolt carrier extension 170, according to an embodiment.

In an embodiment, the folding stock adapter 100 can also comprise a bolt carrier extension 170, which can be connected to the bolt carrier assembly 180 thus extending its length. This extension in length can compensate for the length added to the rifle by the addition of the folding stock adapter 100 ensuring that the action spring and buffer (not shown in FIG. 1B) can still properly actuate the bolt carrier assembly 180. In an embodiment, the bolt carrier extension 170 can comprise a tapered end 172 configured to fit within an opening 182 comprising the bolt carrier assembly 180. The bolt carrier extension 170 can also comprise a head end 171 configured to contact, and be actuated by the action spring and buffer (not shown in FIG. 1B). The head end 171 can comprise one or more cutout sections 174, the purpose and function of which will be described below.

Figure 1C:
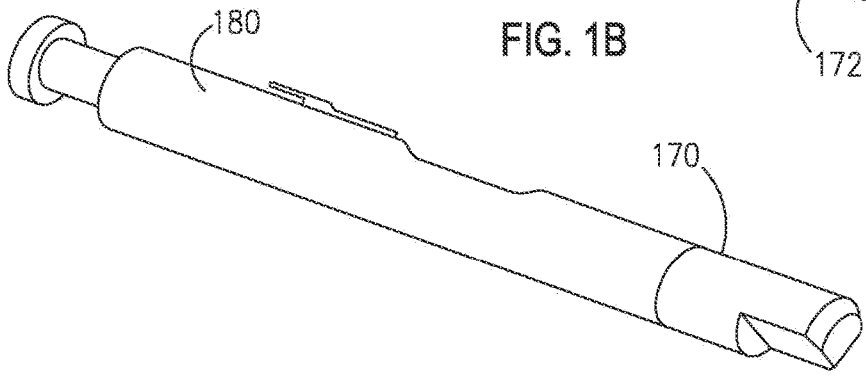
FIG. 1C is a rear, top and side perspective view drawing of a bolt carrier assembly, including a bolt carrier extension, according to an embodiment.

FIG. 1C is a rear, top and side perspective view drawing of a bolt carrier assembly 180 connected to a bolt carrier extension 170 according to an embodiment.

This view shows how the bolt carrier assembly 180 would appear if the tapered end 172 (not shown in FIG. 1C) of the bolt carrier extension 170 was to be placed into the opening 182 comprising the bolt carrier assembly 180 shown in FIG. 1B.

Figure 2:
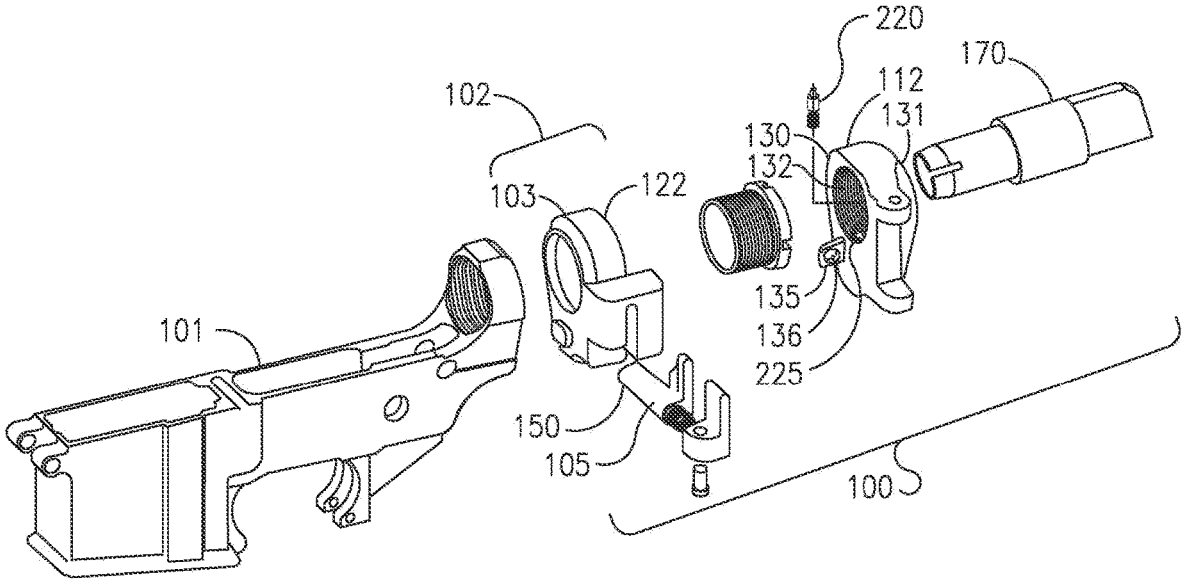
FIG. 2 is an exploded front, top and side perspective view drawing of a folding stock adapter and a receiver (prior art) such as those commonly comprising many military-style assault rifles, according to an embodiment.

FIG. 2 is an exploded front, top and side perspective view drawing of a folding stock adapter 100 and a receiver 101 such as those commonly comprising many military-style assault rifles, according to an embodiment.

In an embodiment, the first live hinge side 130 of the live hinge section 112 can comprise a locking tab 135 which can be configured to be received by the indentation 120 (shown in FIG. 1A) comprising the dead hinge section side 122. When the folding stock adapter 100 is in a closed position, the locking tab 135 can be inserted into the indentation 120 and the tab retainer 520 (not shown in FIG. 2, but shown in FIG. 5) comprising the locking button assembly 105 can be inserted into the locking tab hole 136 in order to lock the folding stock adapter 100 into a closed position. Likewise, the tab retainer 520 comprising the button 150 can be removed from the locking tab hole 136, by pressing in the button 150, in order to allow the folding stock adapter 100 to be placed into an open position thus allowing the stock to be folded against the receiver 101.

In an embodiment, the threaded circular receiver hole 132 can comprise a threaded hole 225, configured to be connected to a buffer retaining pin 220, which can prevent the buffer and action spring (not shown in FIG. 2) from being accidentally removed from the receiver extension (not shown in FIG. 2). The cutout sections 174 (shown in FIG.

1B) comprising the head end 171 of the bolt carrier extension 170 can be configured to allow the bolt carrier extension 170 to pass over the buffer retaining pin 220 so as to facilitate contact with the buffer and action spring.

Figure 3:
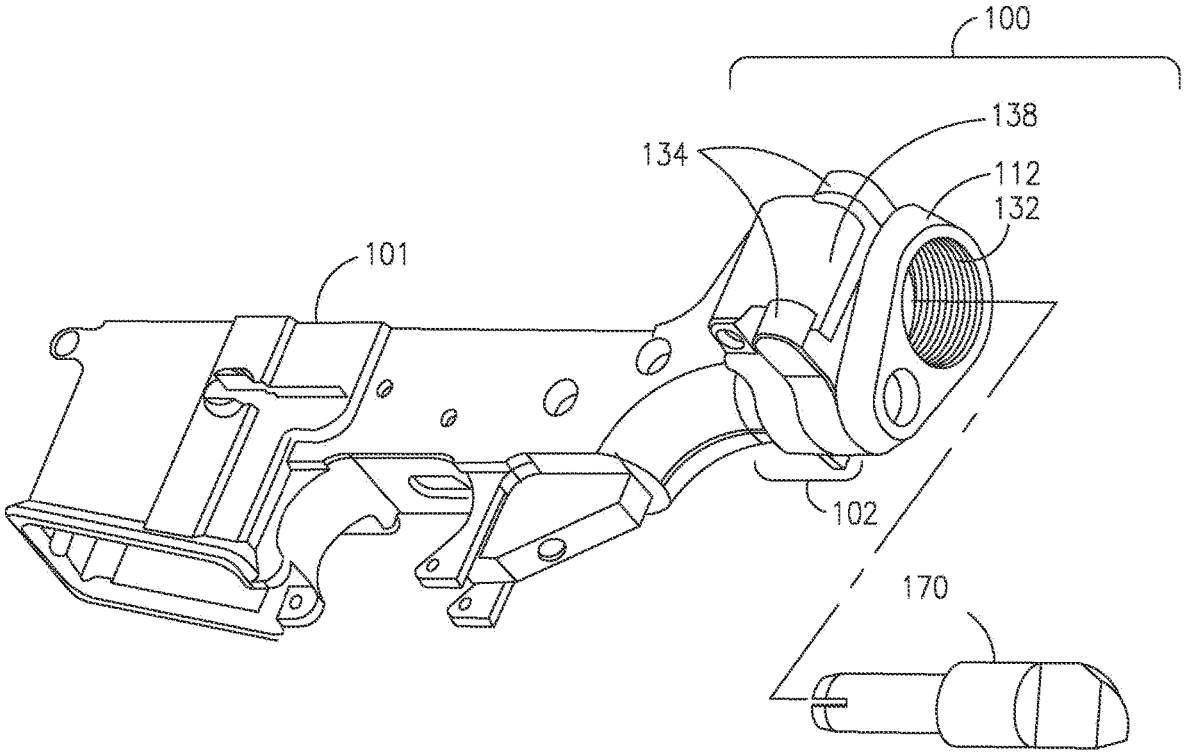
FIG. 3 is a rear, side, and bottom perspective view drawing of a folding stock adapter, in a closed position, connected to a receiver (prior art) such as those commonly comprising many military-style assault rifles, according to an embodiment.

FIG. 3 is a perspective rear, side, and bottom view drawing of a folding stock adapter 100 in a closed position connected to a receiver 101 such as those commonly comprising many military-style assault rifles, according to an embodiment.

In an embodiment, the folding stock adapter 100 can be placed into a closed position wherein two hinge tabs 134 can be rotated about the hinge pivot 138, connected by a hinge pin 139 (not visible in FIG. 3), in order to place the live hinge section 112 against the dead hinge section 102. In this closed position, the receiver 101 can be placed into alignment with the stock (not pictured in FIG. 3) allowing the bolt carrier extension 170 to pass through the threaded circular receiver hole 132, the circular flange hole 141 (see FIG. 1A), and the circular dead hinge section opening 123 (see FIG. 1A). When the folding stock adapter 100 is in this closed position, the receiver 101 and stock are lined up in a functional position and the weapon can be fired normally.

Figure 4:
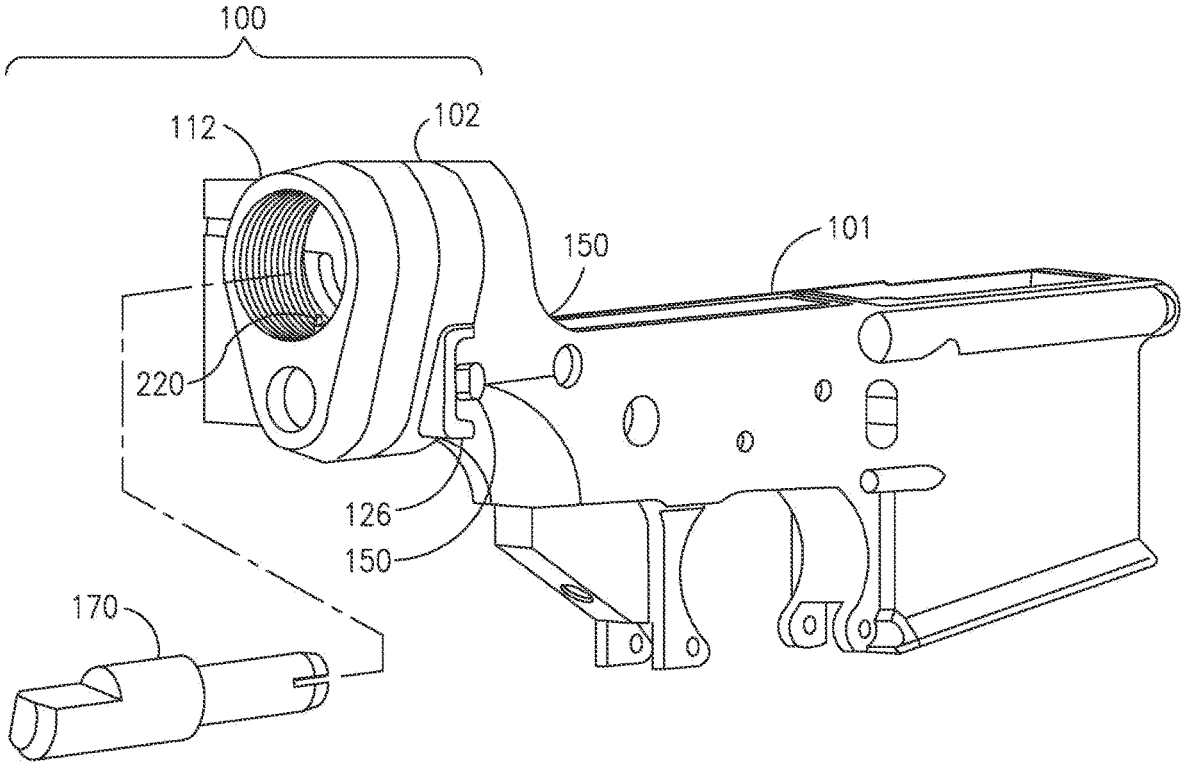
FIG. 4 is a rear, side, and top perspective view drawing of a folding stock adapter in a closed position, connected to a receiver (prior art) such as those commonly comprising many military-style assault rifles, according to an embodiment.

FIG. 4 is a perspective rear, side, and top view drawing of a folding stock adapter 100 in a closed position connected to a receiver 101 such as those commonly comprising many military-style assault rifles, according to an embodiment.

In an embodiment, the folding stock adapter 100 can be in a closed position wherein the locking tab 135 (not pictured in FIG. 4) comprising the live hinge section 112 can be inserted into the indentation 120 (not pictured in FIG. 4) comprising the dead hinge section 102 so that the dead hinge section 102 and the live hinge section 112 can be held together to allow the weapon to be fired. The button 150 can be pressed to release the live hinge section 112 and allow the stock (not viewable in FIG. 4) to be folded against the receiver 101. The dead hinge section 102 can comprise a raised shroud 126 which can help prevent the accidental activation of the button 150.

Figure 5:
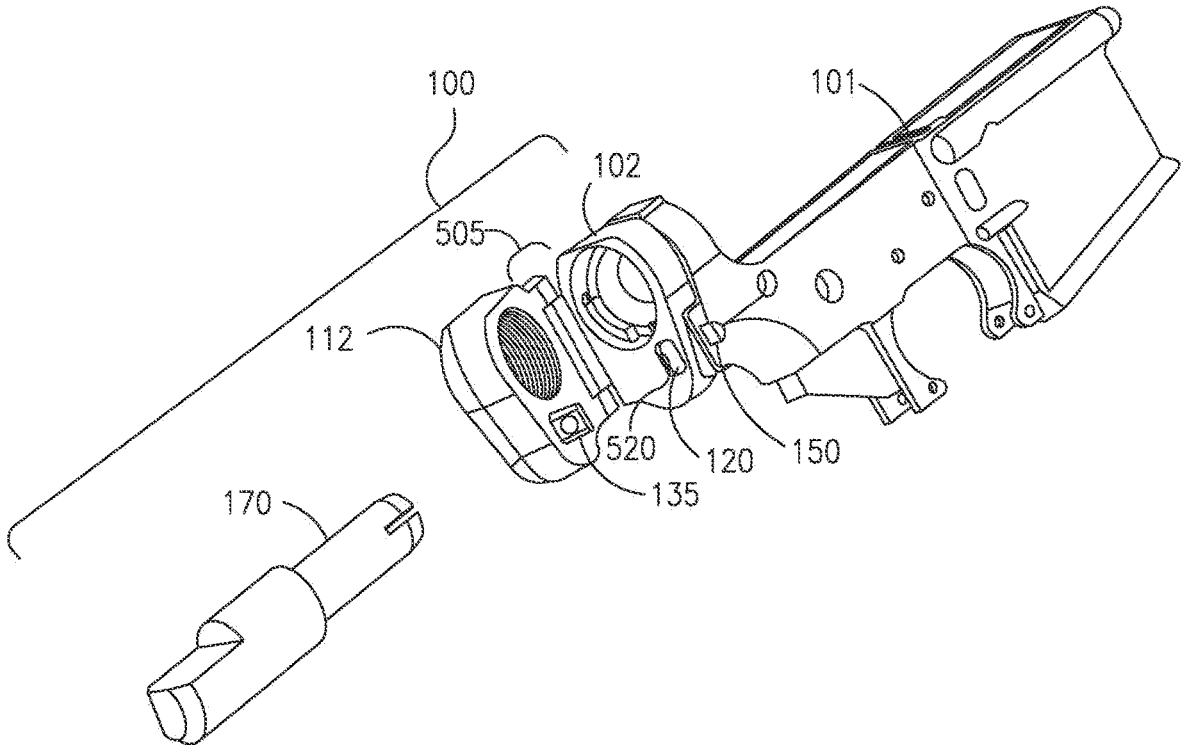
FIG. 5 is a rear, side, and top perspective view drawing of a folding stock adapter in an open position, connected to a receiver (prior art) such as those commonly comprising many military-style assault rifles, according to an embodiment.

FIG. 5 is a perspective rear, side, and top view drawing of a folding stock adapter 100 connected to a receiver 101 such as those commonly comprising many military-style assault rifles, according to an embodiment.

In an embodiment, the folding stock adapter 100 can be in an open position wherein the button 150 has been pressed and the locking tab 135 on the live hinge section 112 has been released from the dead hinge section 102. The dead hinge section 102 remains attached to the receiver 101 while the live hinge section 112 is free to rotate about the hinge assembly 505. As the live hinge section 112 is attached to the stock (not shown in FIG. 5), the stock can also rotate around to one side of the receiver 101, allowing the overall length of the weapon to be reduced by nearly the entire length of the stock.

Figure 6A:
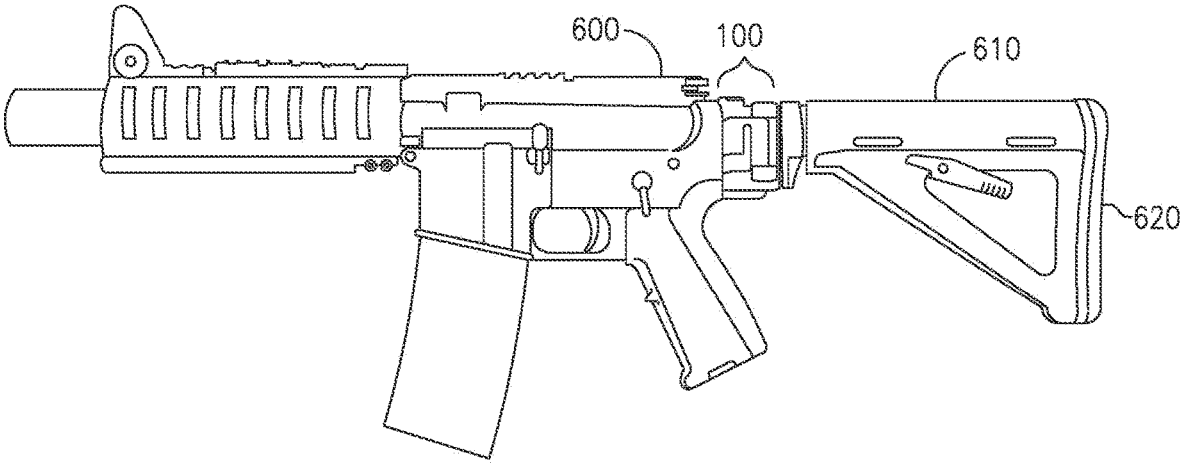
FIG. 6A is a side view drawing of a military-style assault rifle (prior art), comprising a folding stock adapter in a closed (fully functional) position, according to an embodiment.

FIG. 6A is a top and side perspective view drawing of a military-style assault rifle 600 comprising a folding stock adapter 100 in a closed (fully functional) position, according to an embodiment. The buffer and action spring can be located within the receiver extension 610 comprising the stock 620.

Figure 6B:
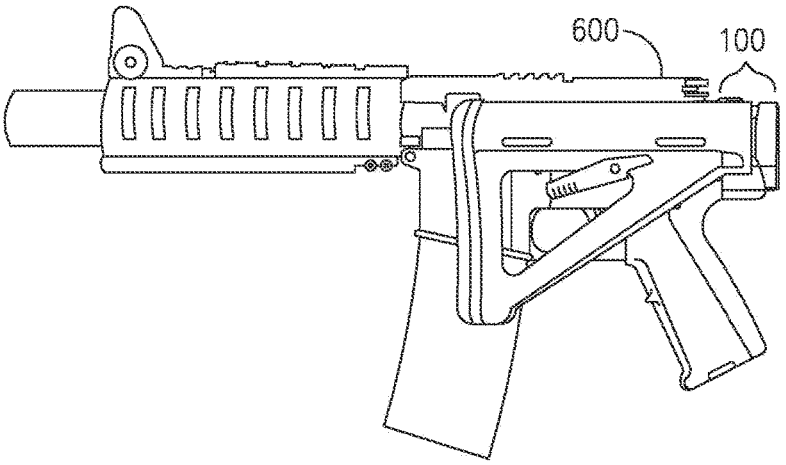
FIG. 6B is a side view drawing of a military-style assault rifle (prior art), comprising a folding stock adapter in an open (folded) position, according to an embodiment.

FIG. 6B is a top and side perspective view drawing of a military-style assault rifle 600, comprising a folding stock adapter 100, in an open (folded) position, according to an embodiment. This drawing, when viewed in comparison to FIG. 6A, clearly illustrates the reduction of the rifle's 600 overall length, when the stock is in the folded position allowed by the folding stock adapter 100.

Figure 7A:
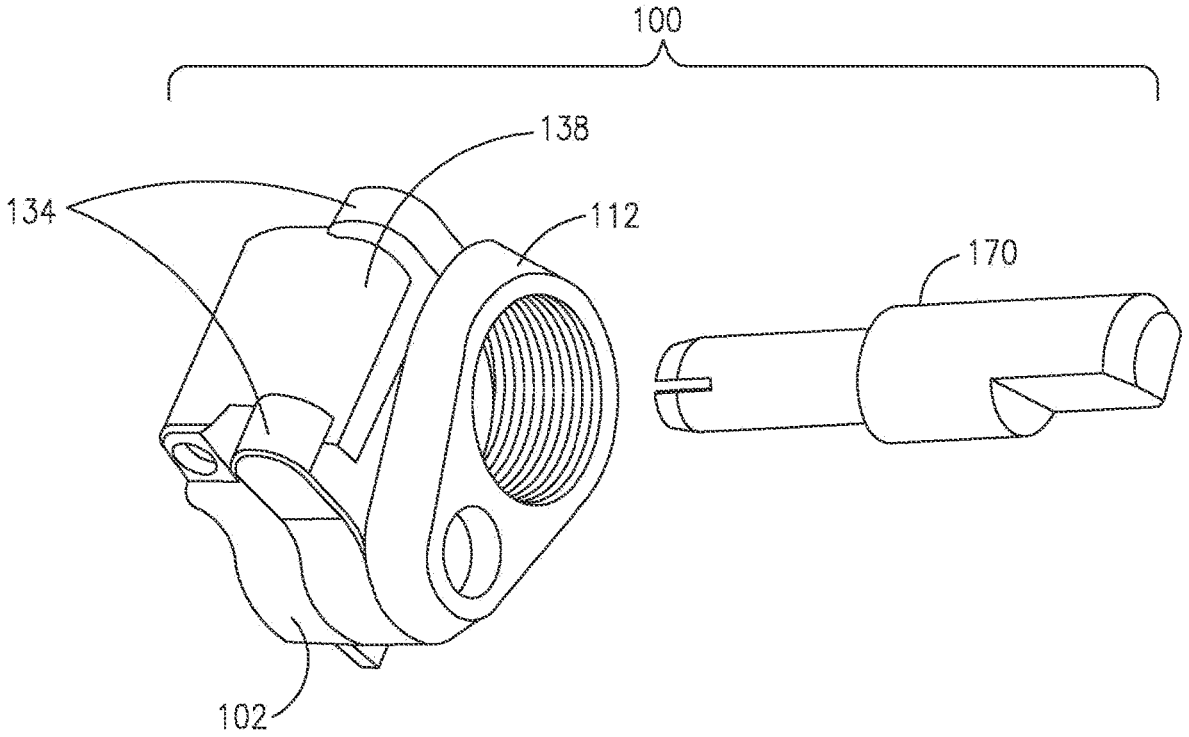
FIG. 7A is a side, bottom and rear perspective view drawing of a folding stock adapter in a closed position, according to an embodiment.

FIG. 7A is a side, bottom and rear perspective view drawing of a folding stock adapter 100 in a closed position, according to an embodiment.

Figure 7B:
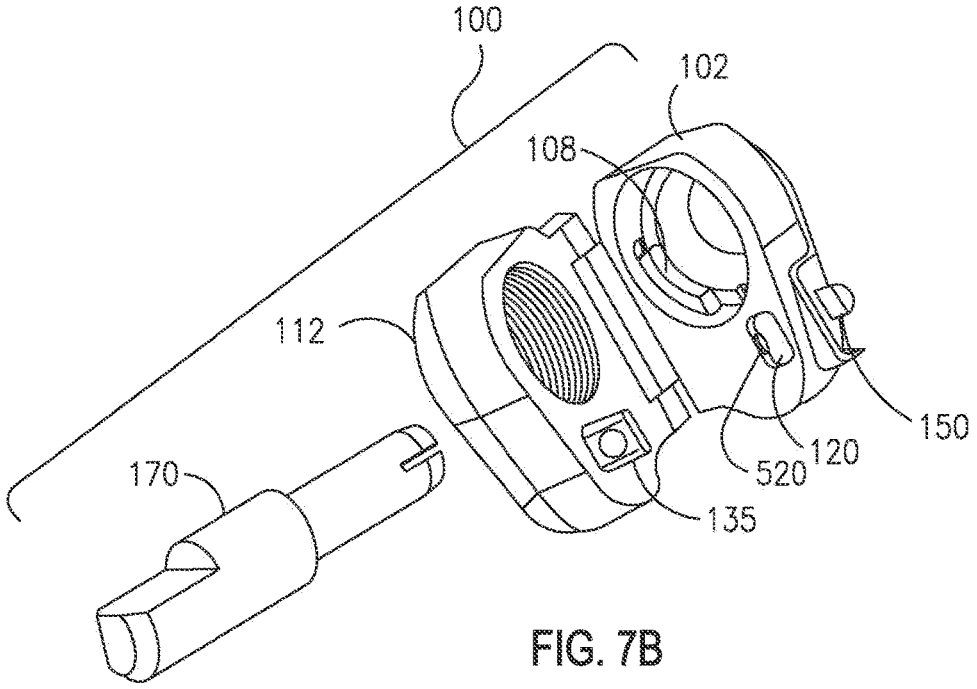
FIG. 7B is a side, top and rear perspective view drawing of a folding stock adapter in an open position, according to an embodiment.

FIG. 7B is a side, top and rear perspective view drawing of a folding stock adapter 100, in an open position, according to an embodiment.

FIGS. 7A and 7B clearly depict the parts that comprise the present folding stock adapter 100 absent any rifle parts to be connected to the adapter. In particular, FIG. 7B clearly shows the tab retainer 520 located within the indentation 120, which can retain the locking tab 135.

Figure 8:
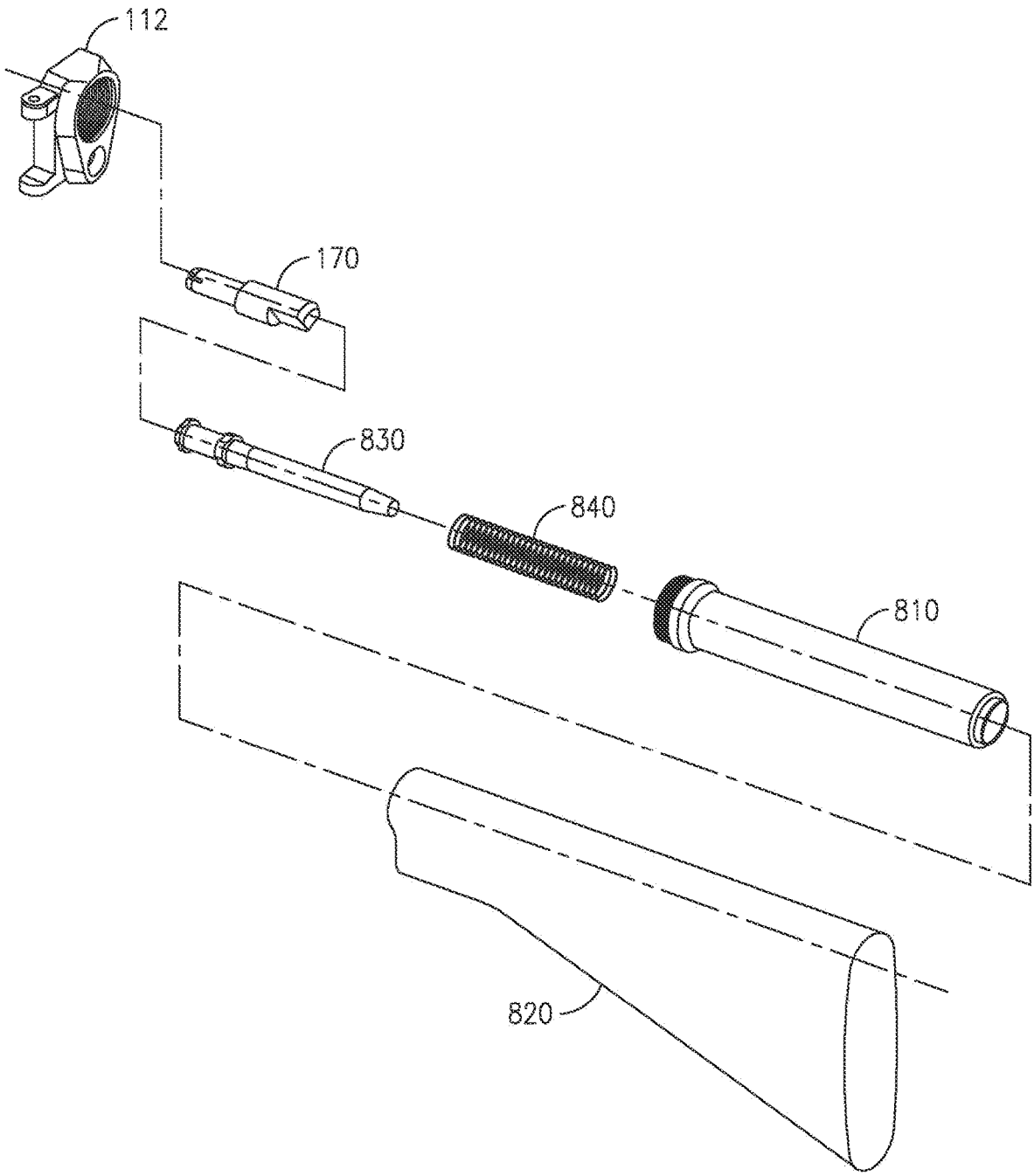
FIG. 8 is an exploded side and rear perspective view drawing of a standard rifle stock (prior art), receiver extension (prior art), action spring (prior art), buffer (prior art), bolt carrier extension, and live hinge section, according to an embodiment.

FIG. 8 is an exploded side and rear perspective view drawing of a standard rifle stock 820 (prior art), receiver extension 810 (prior art), action spring 840 (prior art), buffer 830 (prior art), bolt carrier extension 170, and live hinge section 112, according to an embodiment.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for using a folding stock adapter for a rifle comprising:

providing a folding stock adapter comprising a dead hinge section comprising a dead hinge opening, a live hinge section comprising a live hinge opening, and a hinged joint configured to connect the live hinge section to the dead hinge section allowing the live hinge section and dead hinge section to move between an open position and a closed position wherein the dead hinge opening and the live hinge opening create a continuous tube passing through both the dead hinge section and the live hinge section when in the closed position;

connecting the dead hinge section of the folding stock adapter to the rear threaded section of the receiver by screwing the threaded flange into the rear threaded section of the receiver;

connecting the stock to the live hinge section by screwing the receiver extension into the dead hinge section;

placing the rifle into a folded position by placing the folding stock adapter in an open position; and placing the rifle into an unfolded position by placing the folding stock adapter in a closed position.

2. A method for using a folding stock adapter as described in claim 1 further comprising a threaded flange configured to connect the dead hinge section to a receiver.

3. A folding stock adapter as described in claim 1 further comprising a bolt carrier extension.

4. A method for using a folding stock adapter as described in claim 1 wherein the live hinge section is configured to be connected to a receiver extension comprising a rifle's stock.

5. A method for using a folding stock adapter as described in claim 1 wherein the live hinge section can comprise a buffer retaining pin configured to retain an action spring and buffer mostly within a receiver extension connected to the live hinge section.

6. A method for using a folding stock adapter as described in claim 2 wherein the locking button assembly also comprises a tab configured to retain a bolt carrier assembly mostly within the receiver and dead hinge section when the folding stock adapter is in an open position and the dead hinge section is connected to a receiver.

7. A method for using a folding stock adapter as described in claim 1 wherein the dead hinge section is configured to allow the bolt carrier extension to pass through it when the folding stock adapter is in a closed position.

8. A method for using a folding stock adapter as described in claim 1 wherein the threaded flange is configured to allow the bolt carrier extension to pass through it when the folding stock adapter is in a closed position.

9. A method for using a folding stock adapter as described in claim 1 wherein the live hinge section is configured to allow the bolt carrier extension to pass through it when the folding stock adapter is in a closed position.

10. A method for using a folding stock adapter as described in claim 2 wherein the locking button assembly comprises a button.

11. A method for using a folding stock adapter as described in claim 1 wherein the threaded flange comprises a head and the dead hinge section comprises a raised lip and the head can be used to exert force against the raised lip to secure the dead hinge section against the receiver.

12. A method for using a folding stock adapter as described in claim 5 wherein the bolt carrier extension comprises one or more cutout sections configured to allow the bolt carrier extension to pass over the buffer retaining pin and through the live hinge section.

13. A method for using a folding stock adapter as described in claim 10 wherein the locking button is surrounded by a raised shroud.

14. A method for using a folding stock adapter as described in claim 1 wherein the bolt carrier extension comprises a tapered end.

15. A method for using a folding stock adapter as described in claim 2 wherein the locking button assembly comprises a tab for retaining the bolt carrier assembly.

16. A method for using a folding stock adapter as described in claim 1 wherein the hinged joint comprises a stay to retain the folding stock adapter in the open position.

17. A method for using a folding stock adapter as described in claim 1 wherein the hinged joint comprises a stay to retain the folding stock adapter in the closed position.

* * * * *